US006001035A

United States Patent [19]

Roberts

[11] Patent Number: 6,001,035

[45] Date of Patent: Dec. 14, 1999

[54] HIGH TEMPERATURE HEAT TOLERANT HOCKEY STICK SHAFT

[75] Inventor: Douglas Roberts, Van Nuys, Calif.

[73] Assignee: Jas. D. Easton, Inc., Van Nuys, Calif.

[21] Appl. No.: 08/822,180

[22] Filed: Mar. 20, 1997

Related U.S. Application Data

[63] Continuation of application No. 08/490,783, Jun. 15, 1995, abandoned.

[51] Int. Cl.[6] ..... A63B 59/12

[52] U.S. Cl. ..... 473/562; 473/560

[58] Field of Search ..... 473/560, 561, 473/562, 309, 563

[56] References Cited

U.S. PATENT DOCUMENTS

| | | | |
|---|---|---|---|
| 3,176,987 | 4/1965 | Johnston | 473/309 |
| 3,809,401 | 5/1974 | Hankele | 273/67 A |
| 3,825,991 | 7/1974 | Cornell | 473/309 |
| 3,934,875 | 1/1976 | Easton | 273/67 A |
| 4,086,115 | 4/1978 | Sweet | 273/67 A |
| 4,361,325 | 11/1982 | Jasen | 273/67 A |
| 4,591,155 | 5/1986 | Adachi | 273/67 A |
| 5,050,878 | 9/1991 | Deleris | 273/67 A |
| 5,184,819 | 2/1993 | Desbiolles | 473/309 |
| 5,205,552 | 4/1993 | Green | 473/309 |
| 5,303,916 | 4/1994 | Rodgers | 273/67 A |
| 5,496,027 | 3/1996 | Christian | 473/562 |
| 5,511,780 | 4/1996 | Vadersen | 473/309 |
| 5,643,105 | 7/1997 | Niswander | 473/309 |
| 5,688,188 | 11/1997 | Chapell | 473/309 |

FOREIGN PATENT DOCUMENTS

| | | | |
|---|---|---|---|
| 633295 | 12/1961 | Canada | 273/67 A |
| 021334 | 9/1994 | WIPO | 273/67 A |

*Primary Examiner*—Sam Rimell
*Attorney, Agent, or Firm*—Roth & Goldman

[57] ABSTRACT

A hockey stick shaft of the type employing a shaft susceptible to damage from heating to high temperatures and a socket for receiving a replaceable blade which is held fixedly therein during play, and where the shaft is heated to allow replacement of the blade, incorporating a heat tolerant shaft segment for receiving the blade, the heat tolerant segment extending not more than one half the total length of the shaft and formed of a heat tolerant material not degraded for hockey play by application of heat from a high temperature heat source in changing the blade, the remainder of the shaft being heated to a lesser extent than the heat tolerant segment when heat is applied in carrying out blade replacement.

9 Claims, 1 Drawing Sheet

HIGH TEMPERATURE HEAT TOLERANT HOCKEY STICK SHAFT

CROSS REFERENCE TO RELATED APPLICATIONS, IF ANY

This application is a continuation of application Ser. No. 08/490,783, filed Jun. 15, 1995, now abandoned.

BACKGROUND OF THE INVENTION AND PRIOR ART

1. Field of the Invention

This invention relates to a hockey stick for use in playing hockey. More specifically, the invention relates to a hockey stick having a shaft and a replaceable blade which is firmly affixed to the shaft for play, and which blade is loosened to allow changing of the blade by application of heat to the hockey stick at the juncture of the replaceable blade and the shaft.

2. Description of the Related Art

Hockey sticks for playing the game of hockey historically were made of wood and included a shaft and a blade. More recently, advances in the art have given rise to hockey sticks having components formed of other materials, such as aluminum and composite materials, particularly fiber/resin composites incorporating epoxy and graphite. These newer materials are used because they give rise to advantages in weight and balance of the hockey stick and in its flexural properties. Replaceable blades are another more recent advance, and are generally formed of wood overlaid with a composite material such as fiberglass to strengthen the blade and provide increased durability. Such blades have a shank which is inserted into, and interfits with, a socket formed by an open end of the shaft of known hockey sticks.

Blades must be changed periodically due to wear or damage. In the most widely used configuration, the shank is held within the socket and is thus attached to the shaft by the use of a thermoplastic adhesive, commonly known as a "hot melt" glue. Conventionally, such a hot melt glue is liquefiable at temperatures well above that normally encountered in using a hockey stick. When liquified by application of heat such an adhesive allows removal or installation of a blade, and when allowed to cool, solidifies and adhesively bonds together the shaft and the shank of the blade.

Generally, manufacturers of hockey sticks recommend specific methodologies for heating the shaft of the hockey stick at the location of the hot melt glue-bonded connection at the end of the shaft. Such methodologies feature limiting the maximum temperature of the shaft to a material dependent value which allows liquefaction of the thermoplastic adhesive but is not injurious to the material from which the hockey stick shaft is made. Certain materials, specifically composite materials commonly used in forming the shaft, are susceptible to damage and weakening as a result of heating them to high temperatures, such as may be occasioned by using a flame to heat the shaft in carrying out a blade change, for example.

However, it is often desirable to change a blade quickly, and recommended methods of heating the shaft to effect a blade change take a relatively long time, at least as compared to methods commonly employed by hockey players to heat the end of the shaft. Particularly, during a game, players in a hurry to change a damaged blade, for example, may use a high temperature heat source such as a propane torch or the like, providing a rapid transfer of heat energy to the shaft to facilitate a faster blade replacement.

Composite materials, for example those employing fibrous materials and a resin binder, such as epoxy graphite composite materials of the type commonly used in forming hockey stick shafts, are heated well above the recommended temperature for the material by the application of heat delivered at a very high temperature by a propane torch or the like. Degradation of the structural properties important to strength and flexibility of the shaft often results, and breaking of such hockey sticks along the shaft at such a damaged location has been observed. The dangers attendant a hockey stick breaking in this manner during play are well known. At the least, such a damaged hockey stick may be rendered unusable when it is recognized that the portion of the shaft which receives the blade shank has been damaged, and a tight and reliable union between the shaft and the blade cannot thereafter be accomplished.

Because composite materials as presently used in hockey sticks provide very desirable performance properties, such hockey sticks continue to be used, and damaged, through over-heating, at various levels of play from professional hockey down to neighborhood street hockey, for example. Consequently, it has been recognized that damage caused to composite shafts by over-heating should be mitigated. The objectives of providing a hockey stick using composites having desirable properties and sufficiently low cost, and at the same time, allowing rapid blade changes conventionally made using a high temperature heat source such as a torch or the like, seem desirable and yet mutually exclusive.

The above concerns being recognized, there is a need for a hockey stick shaft for use in a hockey stick of the type having a conventional replaceable blade which provides the advantageous properties of composite materials, yet which allows repeated blade changes through application of heat rapidly and at very high temperatures, such as from a torch for example, to be used. The present invention is directed to this need.

SUMMARY OF THE INVENTION

The present invention is directed to a hockey stick of the type employing a replaceable blade and incorporating a shaft having a first end and a second end, the shaft incorporating a socket at the first end configured to fixedly receive the replaceable blade, the replaceable blade having a shank configured to be received in said socket and held securely therein during play, and where the first end of the shaft adjacent this socket is heated to allow replacement of the blade comprising:

a) a high temperature heat tolerant shaft segment disposed at the first end of the shaft and independently forming a part of the shaft extending less than one half the total length thereof, this shaft segment being formed of a high temperature heat tolerant material not degraded for hockey play by application of heat from a high temperature heat source in changing the blade, and incorporating the socket for receiving the replaceable blade; and b) a remainder segment of said shaft, including the second end of the shaft, said remainder segment extending at least one half the total length of the shaft, this remainder segment of the shaft being heated to a lesser extent than the high temperature heat tolerant segment when heat is applied to the shaft at the first end thereof in carrying out blade replacement.

In a more detailed aspect, the high temperature heat tolerant segment can be advantageously formed of a metal, such as aluminum. The heat tolerant segment can be bonded to the remainder segment using adhesives, or, as particularly applicable to composite shafts employing a resin which is cured, such as epoxy graphite composites, a co-curing process is advantageously used to bond the two segments involving joining the segments before the composite material of the remainder segment is cured and allowing the composite material of the remainder segment to bond to the heat tolerant segment during a cure cycle of the composite remainder segment of the shaft.

In a further more detailed aspect, one shaft segment is provided with a reduced profile segment which interfits with the other segment to provide a telescoping engagement. This provides a mechanical interlock and increased bonding surface area resulting in increased strength of the bond between the remainder shaft segment and high temperature heat tolerant segment.

Other features and advantages of a hockey stick according to principles of the present invention will become apparent from the following detailed description of presently preferred embodiments, with the accompanying drawings, which illustrate, by way of example, the features of the invention.

DETAILED DESCRIPTION OF THE PREFERRED EMBODIMENTS

Figure 1:
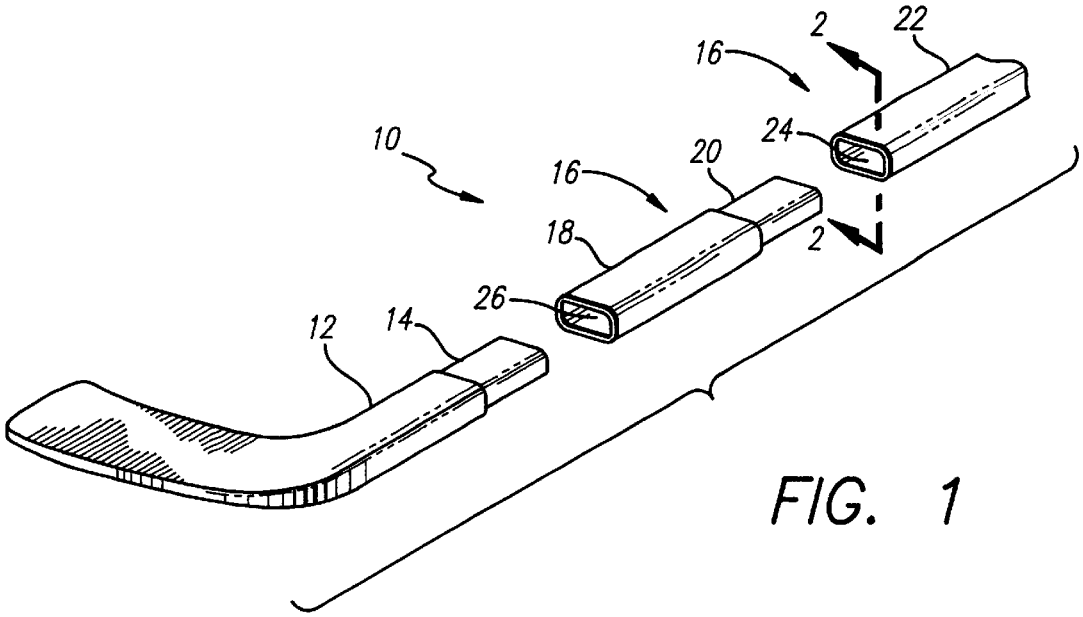
FIG. 1 is an exploded perspective view of a hockey stick according to the invention.

As shown in the accompanying drawings, which are provided by way of example and not by way of limitation, and with specific reference to FIG. 1, a hockey stick 10, according to the invention with a replaceable blade 12 having a shank 14 is illustrated. The blade is connectable with a shaft 16 formed of a composite shaft segment 22, formed of a composite material, such as a light-weight epoxy graphite composite such as is known in the art, for example, and a high temperature heat tolerant metal shaft segment 18. The metal shaft segment 18 may be formed of aluminum or other known metals and alloys of metals which may be heated repeatedly to a high temperature such as may occur when heated using a propane torch or the like (not shown) without degradation of the metal shaft segment 18 in terms of its function as a portion of the hockey stick shaft 16. Other heat resistant materials could be used, but using a metal or metal alloy, specifically aluminum, gives cost and weight advantages over other presently known materials.

The metal shaft segment 18 incorporates an area of reduced profile, comprising a bonding segment portion 20, configured to fit within and in contact with a hollow end 24 of composite shaft segment 22. The composite shaft segment comprises the shaft along the majority of the length of shaft 16.

Figure 2:
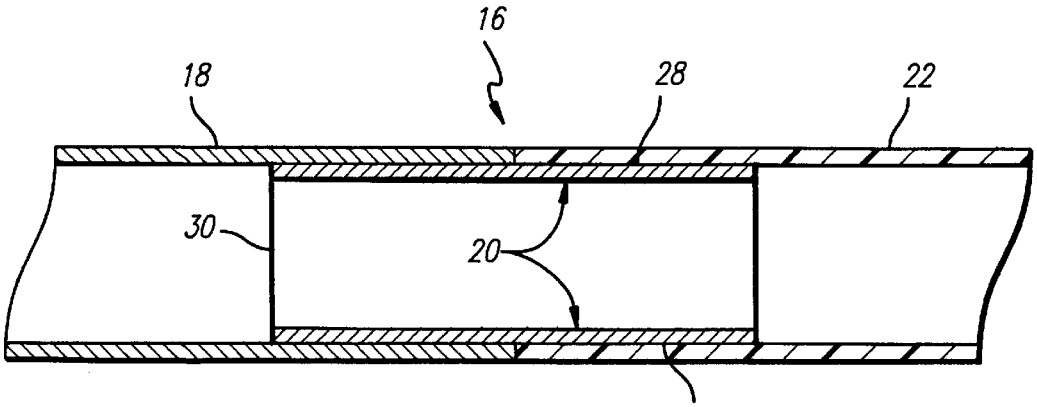
FIG. 2 is a elevational cross-section of a portion of an assembled hockey stick shown disassembled in FIG. 1, taken along line 2—2.

When metal shaft segment 18 and composite shaft segment 22 are bonded together, they form shaft 16. Therefore the shaft is discontinuous with respect to the constituent materials from which it is made, but otherwise is an integral construction acting as a single unit. With reference to FIGS. 1 and 2, the bonding portion 20 of the metal shaft segment 18 is sized to fit inside the hollow end 24 of the composite shaft segment 22 in telescoping fashion, and provides a large surface area for bonding. A socket 26 is formed within and defined by the open end of metal shaft segment. The socket is sized to fit the shank 14 of a conventional replaceable blade 12, and characterizes the portion of the shaft 16 involved in joining the replaceable blade to the shaft.

The metal shaft segment 18 is bonded to the composite shaft segment 22 by an adhesive 28 (FIG. 2). This bond is permanent, and the length of bonding portion 20 of the metal shaft segment is sufficient to provide a reliable bond. A thermosetting adhesive is used, however as will be appreciated, the adhesive may be any of the known adhesives suitable to this application. A suitable high temperature epoxy is an example of such an adhesive. In another embodiment, the composite shaft segment 22 could be joined to bonding portion 20 of the metal shaft segment 18 by a co-curing process. For example, a resin of the composite material used to form composite shaft segment 22, at least in the area of the bond, is provided in an uncured state when the metal shaft segment is joined to the composite shaft segment. The composite material is then cured in place around the bonding portion 20, effecting a permanent bond between the composite shaft segment and the metal shaft segment.

In the illustrated embodiment of FIG. 2, the bonding portion 20 is formed by joining a reduced profile segment 30 to metal shaft segment 18. The illustrated reduced profile segment is formed of the same metal material as metal shaft segment 18 and extends into the metal shaft segment in telescoping fashion. As will be apparent, any of the known ways to effect a metal-to-metal bond could be employed to join the reduced profile segment and the rest of the metal shaft segment together. For example, an interference or press fit, welding, including gas shielded welding, brazing, dip brazing, and adhesives can be employed.

Figure 3:
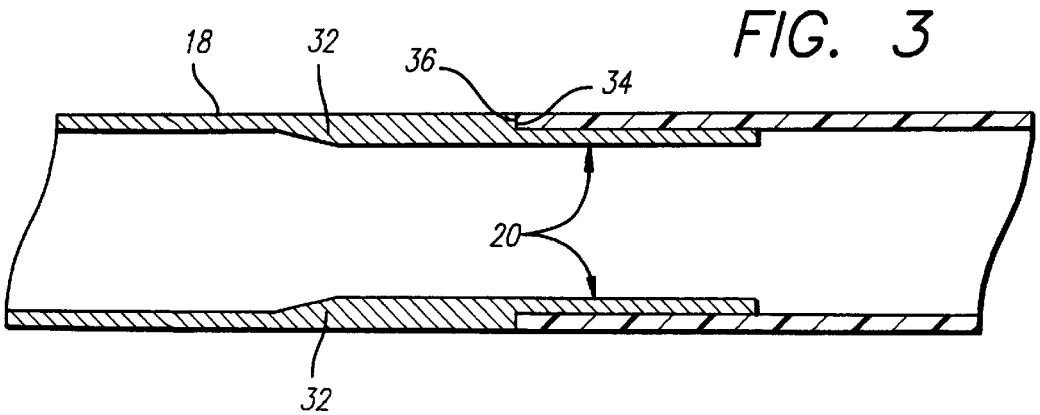
FIG. 3 is a perspective elevational view of an alternate embodiment of the hockey stick shown in FIG. 2.

Referring to FIG. 3, an alternate embodiment of the hockey stick shown in FIG. 2 is illustrated. The metal shaft segment 18 including the bonding portion 20 is formed of a single unitary piece of material. A transition 32 having a gradually increased wall thickness is formed between the bonding portion 20 and the remainder of the metal shaft segment 18 to provide for increased strength, and/or allowing a ledge 34 to be formed. The ledge provides a bonding surface 36 against which the composite shaft segment 22 butts. Optimally, this ledge 34 provides a vary narrow gap between composite shaft segment 22 and metal shaft segment 18. As will be apparent, the transition 32 in this embodiment, or the reduced profile segment 30 of FIG. 2 may also act as a stop for the inserted shank 14 of the replaceable blade 12.

The illustrated configuration of FIG. 3 can be accomplished using aluminum or other metals or metal alloys, as well as other high temperature heat tolerant materials of suitable strength and flexural properties. Using aluminum, the bonding portion 20 could be formed, for example, by swaging a tubular aluminum workpiece to provide the ledge 34 and the smaller, or more narrow, profile segment defining the bonding portion 20. Other manufacturing methods, for example spinning or stamping or molding processes might be employed, as well as the use of other materials. In the illustrated embodiment, the swaged aluminum tube is formed into the illustrated rectangular configuration using a form dye as is known in the art.

The length and thickness of the transition 32 can be varied, depending for example on the material used to form the metal shaft segment 18, or design considerations for controlling the depth that the shank 14 can be inserted into the socket 26. The transition portion may also be sized to act as a heat reservoir, reducing the amount of heat transmitted to the composite shaft segment 22. As will be appreciated by those skilled in the art, a thickened transition may also be necessitated by the manufacturing process used, or may be the result of a structural consideration. For example, configuring the shaft 16 to have desired strength and flexural properties, including the portion of the shaft where the differing materials are joined, may define the dimensions of the heat tolerant segment 18, including the transition 32.

While several particular forms of the invention have been illustrated and described, it will be apparent that other means of carrying out the invention may be employed, and that various modifications and improvements can be made without departing from the spirit and scope of the invention. Accordingly, it is not intended that the invention be limited, except by the appended claims.

I claim:

1. A hockey stick shaft having a first end and a second end, the shaft being configured for use with a replaceable blade and the shaft having a blade socket adjacent the first end adapted to receive a tennon of a replaceable blade, said shaft comprising:

a first shaft segment incorporating said blade socket, said first shaft segment positioned at the first end; and a second shaft segment comprising the majority of the length of said shaft formed of a composite material; said first shaft segment being formed of a material less susceptible to damage from heating than said composite material, and wherein said first shaft segment is bonded to said second shaft segment by an adhesive component of said composite material cured in contact with said first shaft segment.

2. The hockey stick shaft of claim 1, wherein said first material comprises a metal.

3. The hockey stick shaft of claim 2, wherein said first material is aluminum.

4. The hockey stick shaft of claim 1, wherein said first shaft segment includes a tubular tenon and said composite second shaft segment includes a socket receiving said tenon.

5. The hockey stick shaft of claim 1, wherein said second shaft segment is formed of a composite material which includes graphite reinforcing fibers.

6. The hockey stick shaft of claim 5, wherein said second shaft segment is formed of a composite material comprising epoxy and graphite fibers.

7. The hockey stick shaft of claim 4, wherein said second shaft segment comprises a tubular member.

8. The hockey stick shaft of claim 7, wherein the wall thickness of the tubular first shaft segment is increased for a length intermediate the blade tenon receiving socket and the tubular tenon.

9. The hockey stick shaft of claim 1, wherein said length of increased wall thickness provides a heat reservoir in said first shaft segment to prevent excessive heat applied to said blade receiving socket from being conducted from said hollow tenon to said composite section of said shaft.

* * * * *